US007992991B2

(12) United States Patent
Kawabata

(10) Patent No.: US 7,992,991 B2
(45) Date of Patent: Aug. 9, 2011

(54) IMAGE FORMING APPARATUS

(75) Inventor: Kenichi Kawabata, Isehara (JP)

(73) Assignee: Ricoh Company, Ltd., Tokyo (JP)

( * ) Notice: Subject to any disclaimer, the term of this patent is extended or adjusted under 35 U.S.C. 154(b) by 1025 days.

(21) Appl. No.: 11/827,924

(22) Filed: Jul. 13, 2007

(65) Prior Publication Data

US 2008/0012921 A1 Jan. 17, 2008

(30) Foreign Application Priority Data

Jul. 14, 2006 (JP) ..... 2006-193465

(51) Int. Cl.
*B41J 2/01* (2006.01)

(52) U.S. Cl. ..... 347/104

(58) Field of Classification Search ..... 347/104
See application file for complete search history.

(56) References Cited

U.S. PATENT DOCUMENTS 5,646,668 A * 7/1997 Fujioka et al. ..... 347/104
2005/0194730 A1* 9/2005 Nishida et al. ..... 271/10.01
2006/0050104 A1 3/2006 Sakakitani
2006/0181569 A1 8/2006 Kawashima et al.
2007/0201936 A1* 8/2007 Nakashima et al. ..... 400/629

FOREIGN PATENT DOCUMENTS

JP 2000-155479 6/2000
JP 2000-246981 9/2000
JP 2004-175494 6/2004
JP 2004-175499 6/2004

OTHER PUBLICATIONS

Mar. 8, 2011 Japanese official action in connection with a counterpart Japanese patent application.

* cited by examiner

*Primary Examiner* — Matthew Luu
*Assistant Examiner* — Kendrick X Liu
(74) *Attorney, Agent, or Firm* — Cooper & Dunham LLP

(57) ABSTRACT

An image forming apparatus stably conveys a recording medium, and includes a conveyance roller, a driven roller, a conveyance belt, an image forming unit and a pressing member. The conveyance belt is rotated by the conveyance roller while supported by the conveyance roller and the driven roller, and is configured to convey the recording medium while electrostatically attracting the recording medium. The pressing member presses the recording medium against the conveyance belt at a position between the conveyance roller and the image forming unit.

12 Claims, 8 Drawing Sheets

IMAGE FORMING APPARATUS

TECHNICAL FIELD

The present disclosure generally relates to an electrostatic sheet conveying apparatus and an image forming apparatus using the same, and more particularly to an electrostatic sheet conveying apparatus conveying a recording medium, and an image forming apparatus provided with the electrostatic sheet conveying apparatus.

DISCUSSION OF THE BACKGROUND

Inkjet recording apparatuses are popularly used for printers, facsimiles, copiers and multifunctional machines including functions of printer, facsimile and copier. An inkjet recording apparatus, for example, forms an image on a sheet using a recording head or an image forming mechanism equipped with a liquid droplet ejecting head for forcing "ink droplets" of a recording liquid (hereinafter referred to as ink droplets) out to adhere the ink droplets to the sheet while conveying the sheet. Thereby, image formation is carried out. The term "sheet" as used herein not only refers to a paper sheet, but also refers to a recording medium, a transfer material, a recording sheet and the like. The term "image formation" as used herein refers to recording, printing and imaging.

An image forming apparatus can form images on any of various materials as the recording medium, such as paper, thread, fiber, cloth, leather, metal, plastics, glass, wood, and ceramics, by ejecting ink droplets. The term "image formation" as used herein not only refers to forming an image with meanings, such as characters or figures on a recording medium, but also refers to formation of an image without meanings such as patterns. The term "liquid" as used herein is not limited to a recording liquid or an ink, but any kinds of fluids that can be ejected can also be used.

In a case where an image is formed by an inkjet recording method, ink is adhered to a sheet. Consequently, the moisture contained in the ink causes the sheet to deform. This phenomenon is referred to as cockling. Due to cockling, the sheet may ripple so that the position of a nozzle of the recording head and the sheet surface varies from place to place. In a case where the level of cockling is high, in a worst case, the sheet touches the nozzle surface of the head, thereby contaminating the nozzle surface of the head and the sheet itself. As a result, the image quality deteriorates, and a misalignment of the ink droplet landing position may occur due to an effect of cockling.

In view of the above, in a related art inkjet recording apparatus, for example, an endless charging belt to maintain the flatness of a sheet is often provided. The charging belt surface is charged so as to electrostatically suction the sheet. By forcing the charging belt to circulate in this state and to convey the sheet, the sheet is prevented from separating from the charging belt (i.e. the sheet is prevented from rippling). Accordingly, the sheet can maintain a high degree of flatness.

Since cockling and curling of a printing sheet affect printing image, in a related art printing sheet conveyance apparatus for carrying out a printing operation in which a printing sheet is electrostatically suctioned by an electrostatic suction member at a printing position to print on the printing sheet and for moving printing sheet, a mechanism for switching, depending on a type of printing sheet used, between a state where the printing sheet is suctioned by the electrostatic suction member and a state where the printing sheet is not suctioned by the electrostatic suction member is proposed.

BRIEF SUMMARY

In an aspect of this disclosure, there is provided an image forming apparatus to stably convey a recording medium. In an exemplary embodiment, an image forming apparatus may include a conveyance roller, a driven roller, a conveyance belt, an image forming unit and a pressing member. The conveyance belt is rotated by the conveyance roller while supported by the conveyance roller and the driven roller and is configured to convey the recording medium while electrostatically attracting the recording medium. The pressing member presses the recording medium against the conveyance belt at a position between the conveyance roller and the image forming unit.

Additional aspects, features and advantages will be more fully apparent from the following detailed description of exemplary embodiments, the accompanying drawings and the appended claims.

BRIEF DESCRIPTION OF THE DRAWINGS

A more complete appreciation of the disclosure and many of the aforementioned aspects, features and advantages will be readily obtained as the same becomes better understood by reference to the following detailed description when considered in connection with the accompanying drawings, wherein.

DETAILED DESCRIPTION OF EXEMPLARY EMBODIMENTS

Figure 1:
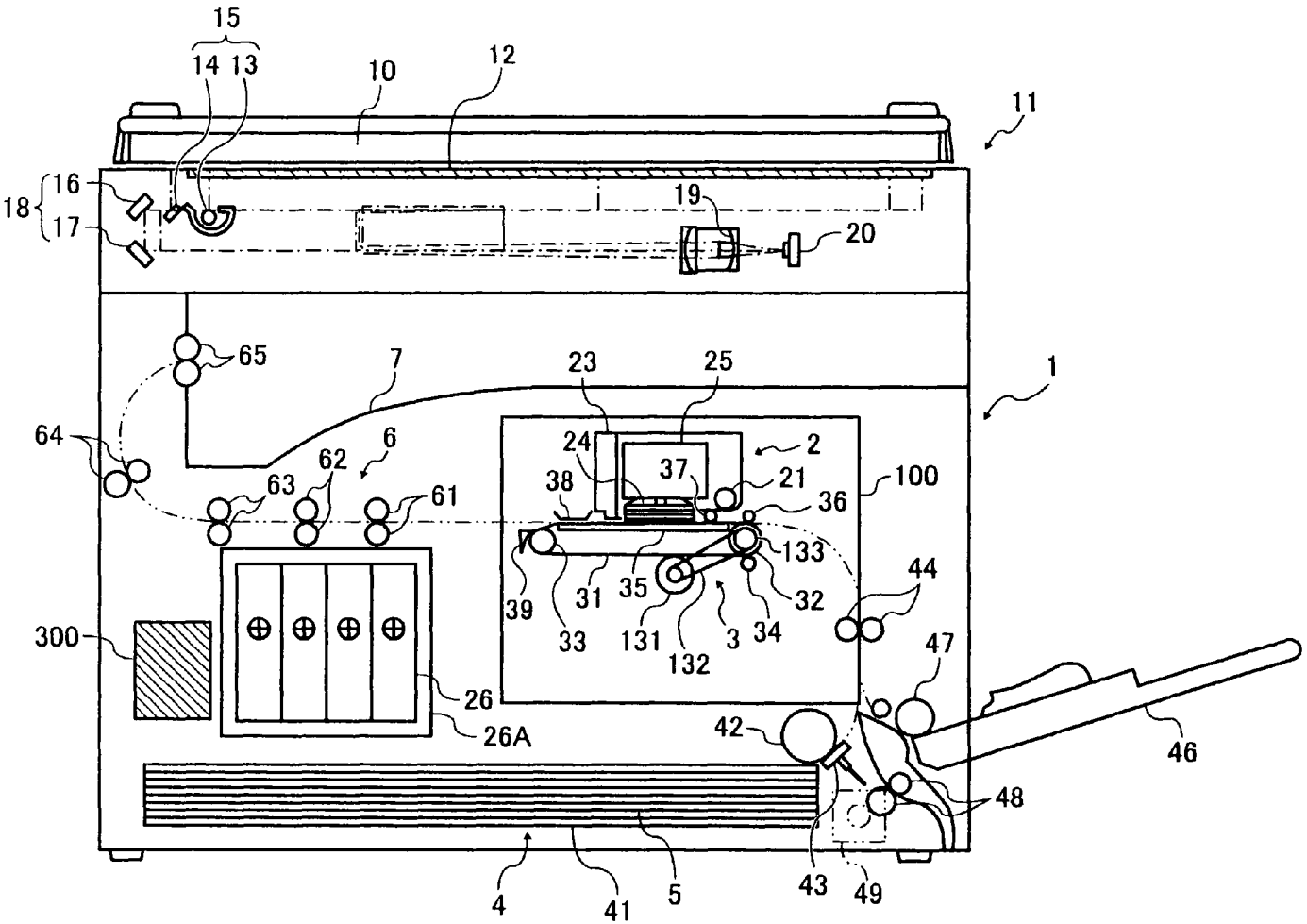
FIG. 1 is a schematic diagram illustrating an overall structure of an image forming apparatus embodying the subject matter of this disclosure.

It will be understood that if an element or layer is referred to as being "on," "against," "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe relationship between one element or feature and another element(s) or feature(s), as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, a term such as "below" can encompass both an orientation of above and below. The device may be otherwise oriented (rotated 90 degrees or at other orientations) and the spatially relative descriptors used herein can be interpreted accordingly.

Although the terms "first", "second", etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing examples and/or embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 3, an example of an engine unit of an image forming apparatus according to an exemplary embodiment is explained.

Figure 2:
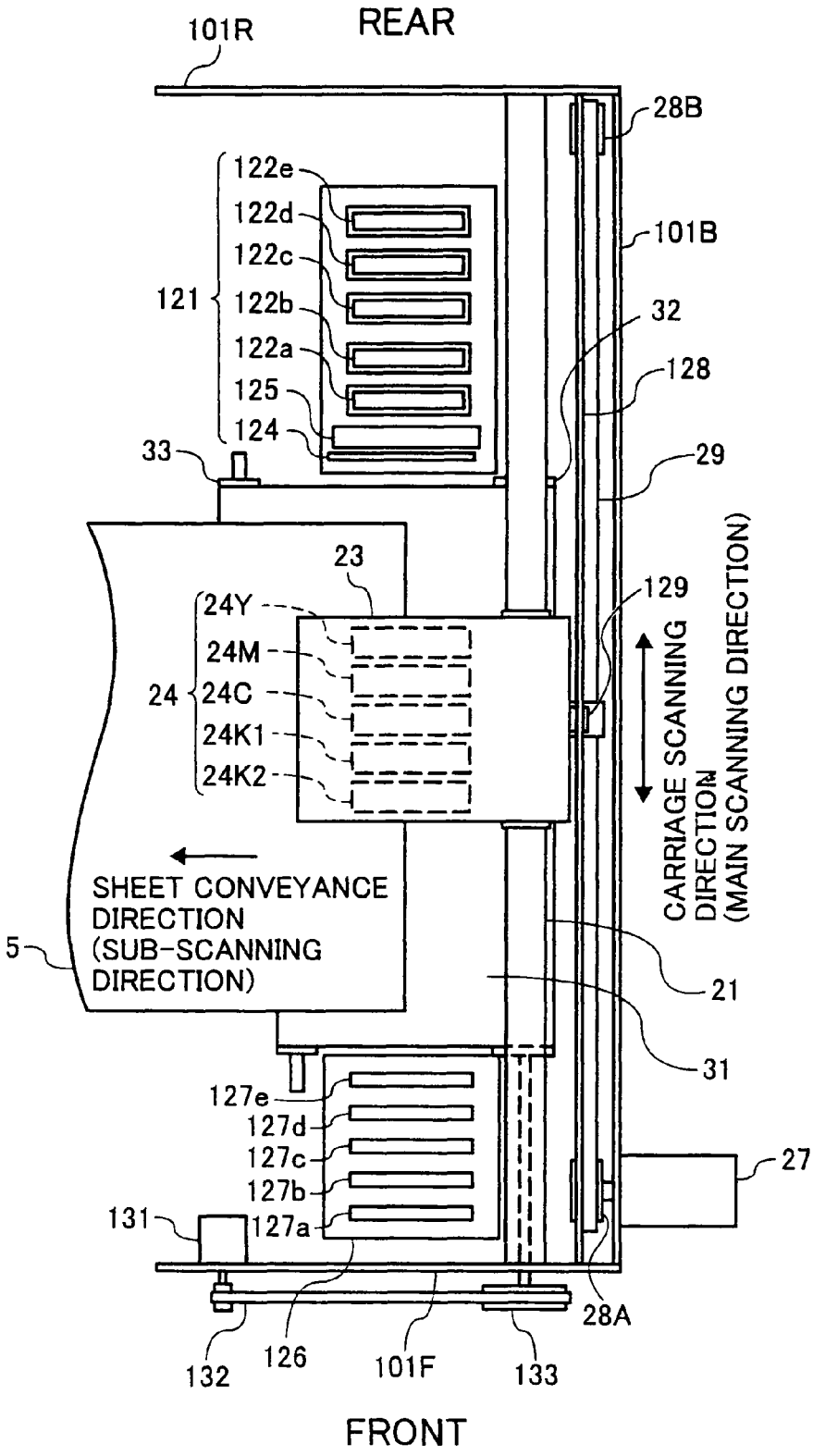
FIG. 2 is a plan view illustrating an image forming unit and a subscanning conveyance unit of the image forming apparatus illustrated in FIG. 1.
Figure 3:
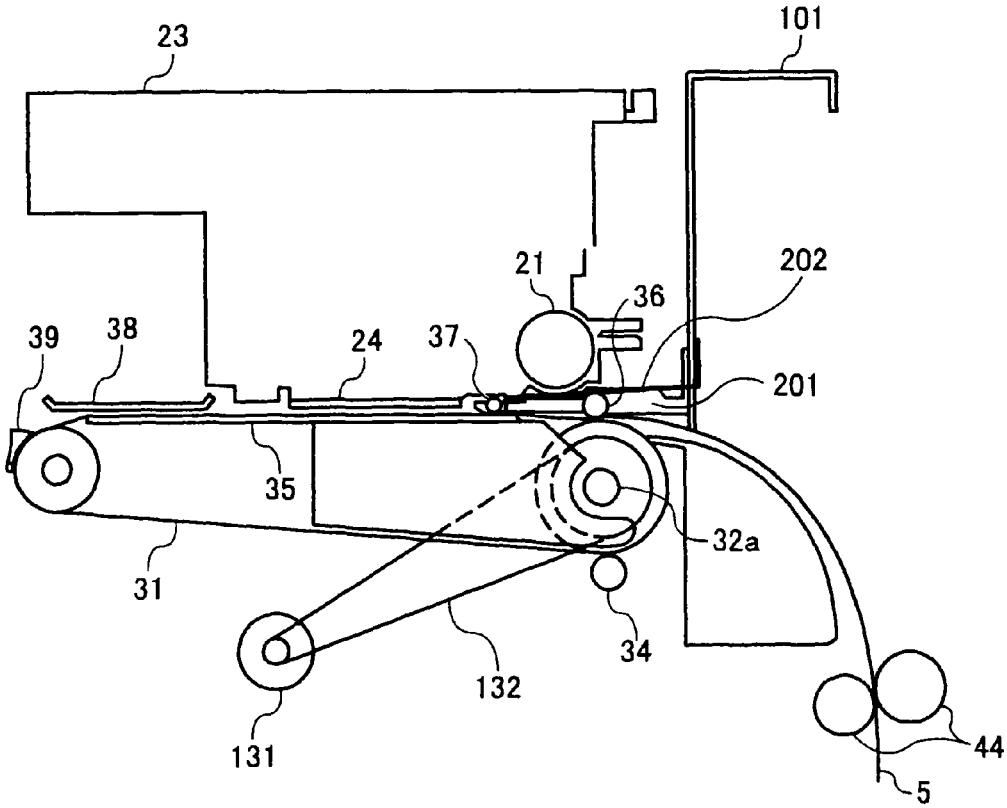
FIG. 3 is a cross-sectional diagram illustrating an example of a configuration of an engine unit in the image forming apparatus of FIG. 1.
Figure 4:
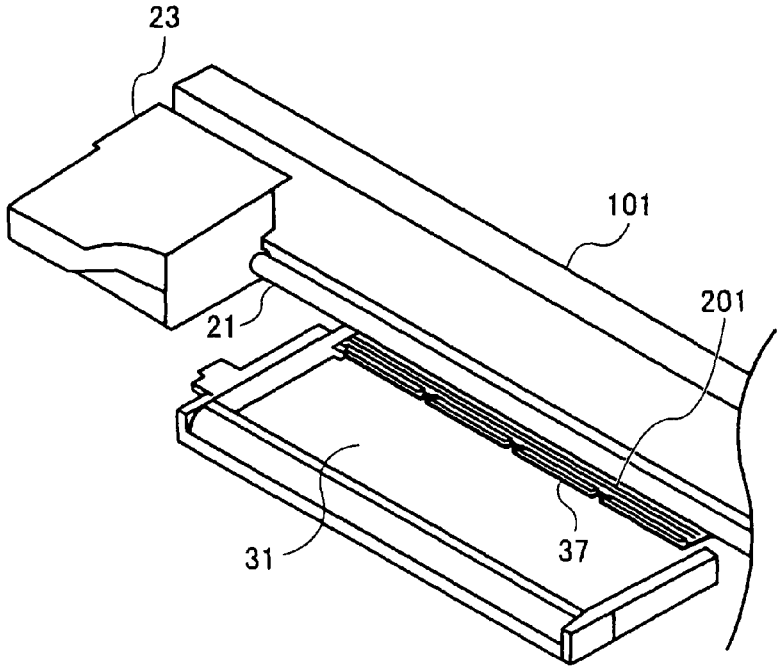
FIG. 4 is a perspective diagram illustrating a principal part of the engine unit illustrated in FIG. 3 in the image forming apparatus of FIG. 1.

Referring now to the drawings, wherein like reference numerals designate identical or corresponding parts throughout the several views, exemplary embodiments of the present disclosure will be explained below with reference to the drawings. FIGS. 1 through 4 illustrate an example of an image forming apparatus including a sheet conveyance apparatus, according to an exemplary embodiment of the present disclosure. FIG. 1 is a schematic diagram illustrating an overall structure of the image forming apparatus. FIG. 2 is a plan view illustrating an image forming unit and a subscanning conveyance unit in the image forming apparatus of FIG. 1. FIG. 3 is a cross-sectional diagram illustrating an example of a configuration of an engine unit in the image forming apparatus of FIG. 1. FIG. 4 is a perspective diagram illustrating a principal part of an engine unit in the image forming apparatus of FIG. 1.

In a main body or a housing 1 of the image forming apparatus, an image forming unit (mechanism) 2, a subscanning conveyance unit (mechanism) 3, a sheet feeding unit (mechanism) 4, a sheet ejecting unit 6, a catch tray 7 and so forth are provided. The image forming mechanism 2 forms an image while conveying the sheet. The subscanning conveyance mechanism 3 conveys the sheet. The sheet feeding unit 4 is disposed at the bottom of the housing 1 and feeds a sheet 5 one sheet at a time. The subscanning conveyance unit 3 conveys the sheet 5 intermittently at a position where the sheet faces the image forming unit 2. After ink droplets are ejected on the sheet 5 to form or record a necessary image in the image forming unit 2, the sheet 5 is ejected on the catch tray 7 formed on an upper surface of the housing 1 through the sheet ejecting unit 6. An engine unit 100, which includes the image forming unit (mechanism) 2 and the subscanning conveyance unit (mechanism) 3, is attachable to or detachable from the main body or the housing 1 of the image forming apparatus.

In the image forming apparatus, an image reading unit or a scanner 11 for reading an image is provided above the catch tray 7 on the upper side of the housing 1 as an input system for image data (print data) created in the image forming unit 2. The image reading unit 11 includes a first optical scanning system 15 (equipped with a light source 13 and a mirror 14), a second optical scanning system 18 (equipped with mirrors 16 and 17), a contact glass 12, a lens 19, and an image reading device 20. The first optical scanning system 15 including the light source 13 and the mirror 14, and the second optical scanning system 18 including the mirrors 16 and 17 move so as to read an image on an original document placed on the contact glass 12. The scanned document image is then read as image signals by the image reading device 20 disposed on the back of the lens 19. Subsequently, the read image signals are digitalized and are subjected to image processing. The print data, in which the image processing is performed, becomes printable. A pressing board 10 for pressing the original document is provided on the contact glass 12.

As shown in FIG. 2, the image forming unit 2 in the image forming apparatus of FIG. 1 movably holds a carriage 23 in a cantilever-like manner by a guide rod 21 and a guide rail (not shown). The guide rod 21 is disposed between a front board 101F and a rear board 101R. The guide rail is provided on a back rail 101B. A main scanning motor 27 causes the carriage 23 to move and scan in a main scanning direction through a timing belt 29 spanned between a driving pulley 28A and a driven pulley 28B.

Recording heads 24 are mounted on the carriage 23. The recording heads 24 are formed of liquid droplet ejecting heads for ejecting droplets of each color and have a shuttle-type head in which the carriage 23 moves in the main scanning direction, and the subscanning conveyance unit 3 sends the sheet 5 in the sheet conveyance direction or the subscanning direction ejecting ink droplets from the recording heads 24 so as to form an image. The recording heads 24 are formed of two ink droplet ejecting heads 24K1 and 24K2 for ejecting black ink, and three ink droplet ejecting heads 24C, 24M and 24Y for ejecting three different colors of cyan (C), magenta (M), and yellow (Y), respectively. Total of five ink ejecting heads are provided. Unless otherwise specified, the ink droplet ejecting heads are hereinafter referred to as the recording heads 24.

Each color of ink is supplied from a corresponding subtank 25 mounted to the carriage 23. As shown in FIG. 1, ink cartridges 26 for each color are attachably/detachably mounted to a cartridge mounting portion 26A from the front of the housing 1. The ink cartridges 26 are of recording liquid cartridges which store different colors of ink, black (K), cyan (C), magenta (M) and yellow (Y), respectively, and supply each color of ink to the sub-tank 25 of respective colors through tubes (not shown). The single ink cartridge 26 supplies black ink to two sub-tanks 25.

Different types of recording heads such as piezoelectric, thermal and electrostatic types may be used for the recording heads 24. The piezoelectric type recording head uses a piezoelectric element as a pressure generating mechanism or an actuator mechanism to press the ink in an ink channel or a pressure generating chamber so as to deform a diaphragm forming a wall of the ink channel. Consequently, the volume of ink channel is changed, thereby ejecting ink droplets. The thermal type recording head uses a heating element to heat the ink in the ink channel so that a bubble is generated. The pressure caused by the generation of the bubble propels the ink droplets out. In the electrostatic type recording head, the diaphragm which forms the wall of the ink channel is disposed across from an electrode so that an electrostatic force is generated between the diaphragm and the electrode. Consequently, the diaphragm is deformed, thereby changing the volume of the ink channel and ejecting ink droplets.

As shown in FIG. 3, a linear scale 128, which has slits, is spanned along the main scanning direction of the carriage 23 between the front board 101F and the rear board 101R. An encoder sensor 129, which is a penetrated type photograph sensor, is provided on the carriage 23. The encoder sensor 129 detects the slits of the linear scale 128. A linear encoder to detect movement of the carriage 23 is formed by the linear scale 128 and the encoder sensor 129.

As shown in FIG. 2, a nozzle condition maintenance/recovery device 121 which maintains and recovers the nozzle condition of the recording heads 24 is disposed in a non-print region on one side of the carriage 23 in the scanning direction. The nozzle condition maintenance/recovery device 121 includes five moisturizing caps 122*a*, 122*b*, 122*c*, 122*d* and 122*e* to cover each of the nozzle surfaces 24*a* of five recording heads 24. The moisturizing caps 122*a* also has a suction function. Unless otherwise specified, the moisturizing caps are hereinafter referred to as the moisturizing caps 122. The nozzle condition maintenance/recovery device 121 further includes a wiping blade 124 for wiping the nozzle surfaces of the recording heads 24, and a waste droplet receiving member 125 for carrying out ejection or so-called "empty ejection" of ink droplets which are not used for recording or image formation.

Furthermore, as shown in FIG. 2, a waste droplet receiving member 126 for carrying out ejection or so-called "empty ejection" of ink droplets, which are not used for recording or image formation from the recording heads 24, is provided in the non-print region on the other side of the carriage 23 in the scanning direction. Five openings 127*a*, 127*b*, 127*c*, 127*d* and 127*e* are formed on the waste droplet receiving member 126, each corresponding to the recording heads. Unless otherwise specified, the openings are hereinafter referred to as the openings 127.

As shown in FIG. 3, the subscanning conveyance unit 3 includes a conveyance roller 32, an endless conveyance belt 31, a driven roller 33, a charging roller 34, a platen guide member 35, a first pressing roller 36, a second pressing roller 37, a guide plate 38 and a separation claw 39. The conveyance roller 32 serving as a drive roller shifts the conveyance direction of the sheet 5 fed from the downward side by approximately 90 degrees so as to convey the sheet 5 facing the image forming unit 2. The endless conveyance belt 31 is laid across the driven roller 33 serving as a tension roller. The charging roller 34 is a charging mechanism to which high voltage (alternating voltage) is applied from a high voltage power source so as to charge the surface of the conveyance belt 31. The platen guide member 35 guides the conveyance belt 31 in the area opposite to the image forming unit 2. The first pressing roller 36 presses the sheet 5 against the conveyance belt 31 at a position opposite to the conveyance roller 32. The second pressing roller 37 presses the sheet 5 against the conveyance belt 31 between the conveyance roller 32 and the recording heads 24. The guide plate 38 holds the upper surface of the sheet 5, on which an image is formed by the image forming unit 2. The separation claw 39 separates the sheet 5, on which the image is formed, from the conveyance belt 31.

The conveyance belt 31 of the subscanning conveyance unit 3 is structured such that when the conveyance roller 32 is rotated via a timing belt 132 and a timing roller 32*a* by a subscanning motor 131, the conveyance belt 31 rotates in the sheet conveying direction or the subscanning direction shown in FIG. 2.

The sheet feeding unit 4 is equipped with a sheet feed cassette 41, a sheet feed roller 42, a friction pad 43, and a pair of registration rollers 44. The sheet feed cassette 41 is removably inserted to the apparatus main body 1 from the front and carries a number of sheets 5. The sheet feed roller 42 and the friction pad 43 separate the sheets 5 stored in the sheet feed cassette 41 one by one, and send the sheet 5. The pair of registration rollers 44 register the supplied sheet 5.

Furthermore, the sheet feeding unit 4 includes a manual feed tray 46, a manual feed roller 47 and a conveyance roller 48. The manual feed tray 46 carries a number of sheets 5. The manual feed roller 47 separates and feeds the sheets 5 one by one from the manual feed tray 46. The conveyance roller 48 vertically conveys the sheets 5 supplied from an optional sheet feed cassette mounted at the bottom of the apparatus main body 1 or from a duplex unit. The member such as the sheet feed roller 42, the registration rollers 44, the manual feed roller 47 and the conveyance roller 48 used for feeding the sheet 5 to the sub-scanning conveyance unit 3 is rotationally driven by a sheet feeding motor or a driving mechanism 49 formed of an HB-type stepping motor, through a not-shown magnetic clutch.

The sheet ejecting unit 6 includes ejection/conveyance rollers 61 and 62 for conveying the sheets 5, and ejection/conveyance rollers 63 and an ejection roller 64 for conveying the sheets 5 to the catch tray 7.

Figure 5:
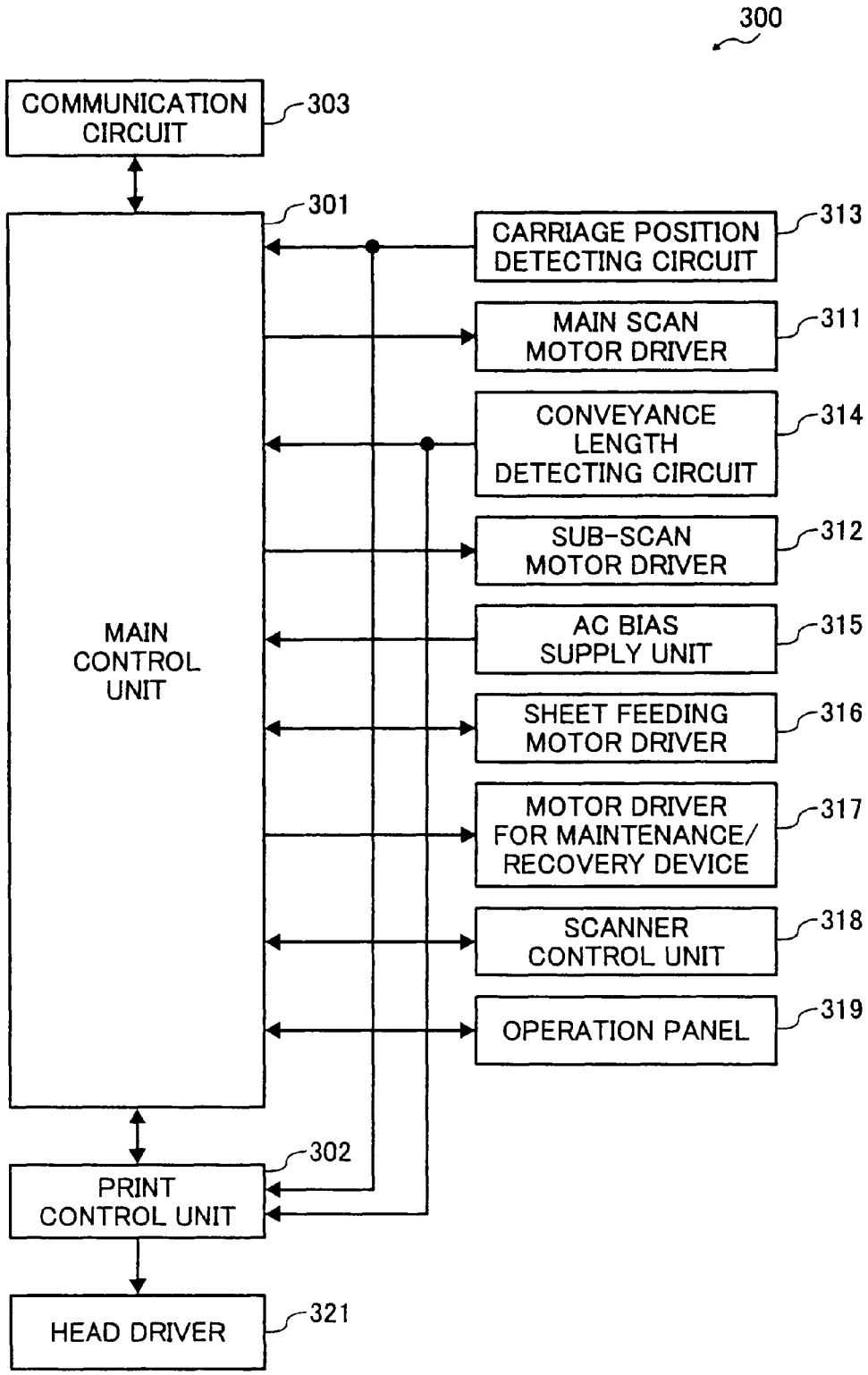
FIG. 5 is a block diagram illustrating an outline of a control unit of the image forming apparatus of FIG. 1.

FIG. 5 is a block diagram illustrating an outline of a control unit of the image forming apparatus of FIG. 1. With reference to a block diagram of FIG. 5, a description will be provided of a control unit of the image forming apparatus. A control unit 300 governs the control of an entire apparatus and is equipped with a main control unit 301. The main control unit 301 includes a CPU, a ROM, a RAM, a volatile memory (VRAM), and an input-output (I/O). The control unit 300 is equipped with a print control unit 302 which includes a computer for controlling print.

The main control unit 301 carries out drive control of the main scanning motor 27 or the subscanning motor 131 through a main scanning motor driver 311 and a subscanning motor driver 312 for forming an image on the sheet 5 based on the information of a printing job input from a communication circuit 303. The main control unit 301 also controls the process of sending out the data for printing to the print control unit 302.

A detection signal of a carriage position detecting circuit 313 is input to the main control unit 301, and the main control unit 301 controls the position and speed of the carriage 23 based on the detection signal. The carriage position detecting circuit 313 counts the slits of the linear scale 128 (an encoder sheet) by the encoder sensor 129 on the carriage 23, and detects the position of the carriage 23. The main scanning motor driver 311 drives to rotate the main scanning motor 27 based on the signal corresponding to the movement of the carriage 23, for example, a PWM output signal in the case of PWM control. Therefore, the carriage 23 may be moved at a predetermined speed to a predetermined position.

A detection signal of a conveyance length detecting circuit 314 is input to the main control unit 301, and the main control unit 301 controls the position and speed of the conveyance belt 31 based on the detection signal. The conveyance length detecting circuit 314 counts the slits of an encoder wheel around the conveyance roller 32 by an encoder sensor, and detects the conveyance length of the conveyance belt 31. The subscanning motor driver 312 drives to rotate the subscanning motor 131 based on the signal corresponding to the conveyance length of the conveyance belt 31 from the main control unit 301. Therefore, the conveyance belt 31 may be moved at a predetermined speed to a predetermined position with driving rotation of the conveyance roller 32.

The main control unit 301 controls charging of the conveyance belt 31 to apply AC bias to the charging roller 34 through an AC bias supply unit 315. The main control unit 301 controls rotation of the sheet feeding motor 49 through a sheet feeding motor driver 316. The main control unit 301 causes the caps 122 to rise and fall, the wiping blade 124 to rise and fall, the suction pump which is not illustrated to drive, and so forth, by rotating the motor (not shown) of the nozzle condition maintenance/recovery device 121 through a motor driver for maintenance/recovery device 317.

The main control unit 301 controls the image reading unit 11 through a scanner control unit 318. The main control unit 301 sends out necessary display information to an operation panel 319, and takes in key information input through the operation panel 319.

The print control unit 302 generates data for driving a pressure generating device for ejecting ink droplets from the recording heads 24 based on a signal from the main control unit 301 and the carriage position detected with the carriage position detecting circuit 313 and the conveyance length detected with the conveyance length detecting circuit 314. The print control unit 302 transmits the above-mentioned image data to a head driver 321 with serial data, a transmission clock, a latch signal, and an ink droplet control signal (mask signal). The print control unit 302 includes a drive waveform generation device and a drive waveform selection device to the head driver 321, which includes a D/A converter for carrying out D/A conversion of the pattern data of the drive signal stored in ROM, a voltage amplifier, a current amplifier, etc. The print control unit 302 generates the drive waveform which consists of a drive pulse (a drive signal) or two or more drive pulses (drive signals), and outputs the drive waveform to the head driver 321.

The head driver 321 drives the recording heads 24 applying drive signals from the print control unit 302 selectively to driving elements, such as the piezoelectric elements, for generating energy for ejecting ink droplets from the recording heads 24 according to image information of serial data corresponding to a line written with the recording heads 24. At this time, by selecting the drive waveform, for example, large droplets (a large dot), medium droplets (a medium dot), small droplets (a small dot) may be selected.

As described above, the amount of rotation of the conveyance roller 32 which drives the conveyance belt 31 is detected. In accordance with the detected rotation amount, the sub-scan motor driver 312 of the control unit 300 controls driving of the subscanning motor 131. In the meantime, an output of the AC bias supply unit 315 which applies a high voltage or an AC bias to the charging roller 34 is controlled. When the AC bias supply unit 315 controls a cycle or a duration of application voltage or charging bias of positive and negative electrodes to be applied to the charging roller 34, and in the meantime, the control unit 300 controls driving of the conveyance belt 31, the positive and negative electric charges may be applied on the conveyance belt 31 for a predetermined charge cycle length. Therefore, a non-uniform electric field is generated.

When the sheet 5 is transferred onto the conveyance belt 31 on which the non-uniform electric field is generated through between the conveyance roller 32 and the first pressing roller 36, the sheet 5 is immediately polarized along a direction of the electric field. Due to the difference in the electric charges, the sheet 5 immediately sticks to the conveyance belt 31 by the force of electrostatic attraction. Therefore, the sheet 5 is conveyed with the motion of the conveyance belt 31.

While the sheet 5 is intermittently transported by the conveyance belt 31, the recording heads 24 eject droplets of the recording liquid or ink droplets on the sheet 5 in accordance with print data so as to form or print an image. The tip of the sheet 5, on which the image is formed, is separated from the conveyance belt 31 by the separation claw 39, and is conveyed to the sheet ejecting unit 6 along the guide plate 38.

During a waiting time of printing (recording), the carriage 23 is moved to the nozzle condition maintenance/recovery device 121 side, the nozzle surface of the recording heads 24 is covered with the moisturizing caps 122 so as to keep moisture in the nozzles for preventing poor ejecting of ink droplets caused by dryness of the ink. The moisturizing cap 122*a* suctions recording ink from the nozzles with the recording heads 24 capped. This is referred to as a nozzle suction or a head suction hereinafter. Therefore, recovery operation is carried out so that high viscosity or bubbles of the ink is reduced. Waste ink on the surface of the recording heads 24 is wiped with the wiping blade 124. Before recording starts or during printing operation, the ink which is not related to record is ejected on the waste droplet receiving member 125, thus, the empty ejection is carried out. Therefore, ejecting performance of the recording heads 24 is stably maintained.

With reference to FIG. 3 and FIG. 4, a description will be provided of the sheet tip pressing with the subscanning conveyance unit (mechanism) 3 of the image forming apparatus. As shown in FIG. 3, the first pressing roller 36 (an entrance pressing roller) and the second pressing roller 37 (a tip pressing roller) are provided to a support member (stay) 201 so as to rotate. In this case, the second pressing roller 37 serving as a sheet tip pressing roller is disposed between the conveyance roller 32 and the image forming area formed by the recording heads 24, that is, a downstream side of the conveyance roller 32 and a upstream side of the recording heads 24 in sheet conveying direction. The endless conveyance belt 31 is pressed between the second pressing roller 37 and the platen guide member 35.

An end portion of the support member 201 is attached to a frame 101 of the engine unit 100. A spring member 202 disposed between the support member 201 and the frame 101 presses the second pressing roller 37 against the endless conveyance belt 31. The support member 201 may be flexible and deformed by the spring member 202 so as to press the second pressing roller 37, or may be movable and moved by the spring member 202 so as to press the second pressing roller 37.

Therefore, the conveyed sheet 5 is pressed to the endless conveyance belt 31 by the first pressing roller 36 at the conveyance roller 32, and electrostatically attached to the endless conveyance belt 31. Further, the conveyed sheet 5 is pressed to the endless conveyance belt 31 by the second pressing roller 37 at the platen guide member 35 before reaching an image forming area with the recording heads 24.

When the sheet 5 is conveyed between the first pressing roller 36 and the conveyance roller 32, even if a tip of the sheet 5 is curled due to its hardness and the tip is separated from the endless conveyance belt 31, the second pressing roller 37 presses the tip to the endless conveyance belt 31 again before reaching the image forming area. Therefore, the tip of the sheet 5 is prevented from touching the recording heads 24.

Figure 6:
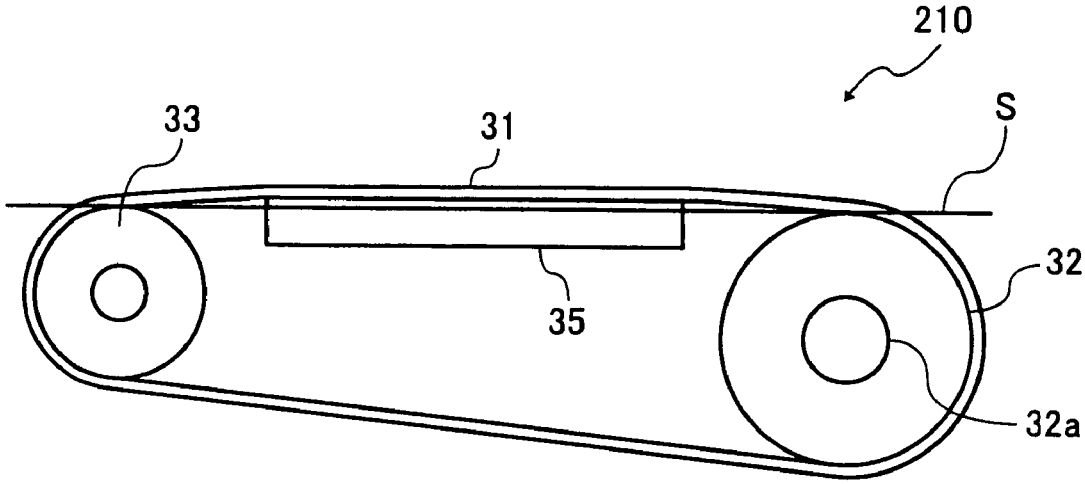
FIG. 6 is a cross-sectional diagram illustrating an endless conveyance belt of the engine unit in the image forming apparatus of FIG. 1.

FIG. 6 is a cross-sectional diagram illustrating a section of the endless conveyance belt of the engine unit in the image forming apparatus of FIG. 1. As shown in FIG. 6, the endless conveyance belt 31 is spanned between the conveyance roller 32 and the driven roller 33. The platen guide member 35 is provided at the inner side of the endless conveyance belt 31 corresponding to an image forming (recording) area by the recording heads 24 for guiding the endless conveyance belt 31. The top surface of the platen guide member 35 is provided so that it may be above a tangent line S to the conveyance roller 32 and the driven roller 33, and it may keep flatness of the endless conveyance belt 31 at the image forming area.

The tip of the sheet 5, which passed between the conveyance roller 32 and the first pressing roller 36, is conveyed toward the recording heads 24. Therefore, the tip of the sheet 5 easily separates from the endless conveyance belt 31 at the upstream end position of the platen guide member 35.

The second pressing roller 37 presses the tip of the sheet 5 against the endless conveyance belt 31 near the end of the platen guide member 35. Therefore, the separation (float) of the tip of the sheet 5 just before reaching the image forming area is surely prevented.

Figure 7:
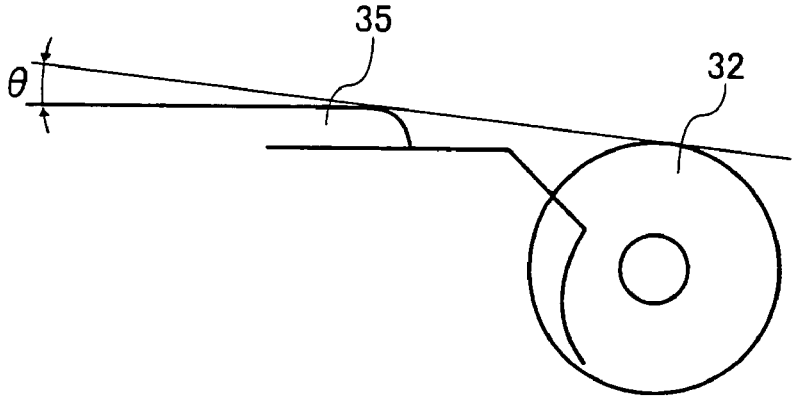
FIG. 7 is a cross-sectional diagram illustrating a relation between a platen guide member and a conveyance roller of the engine unit in the image forming apparatus of FIG. 1.

FIG. 7 is a cross-sectional diagram illustrating a relation between a platen guide member and a conveyance roller of the engine unit in the image forming apparatus of FIG. 1. As shown in FIG. 7, a tangent line to the platen guide member 35 and the conveyance roller 32 and a surface of the platen guide member 35 makes an angle θ. When the θ is not greater than 1.30°, the separation (float) of the tip of the sheet 5 is prevented from attaining the conditions for using a plain paper as the sheet 5.

As mentioned above, the sheet 5 is pressed against the endless conveyance belt 31 between the conveyance roller 32 and the image forming area, the separation (float) of the tip of the sheet 5 is prevented, so that the sheet 5 may be conveyed stably.

In addition, the spring member 202 serving as a pressing member has a simple configuration to generate pressure between the second pressing roller 37 and the endless conveyance belt 31.

Figure 8:
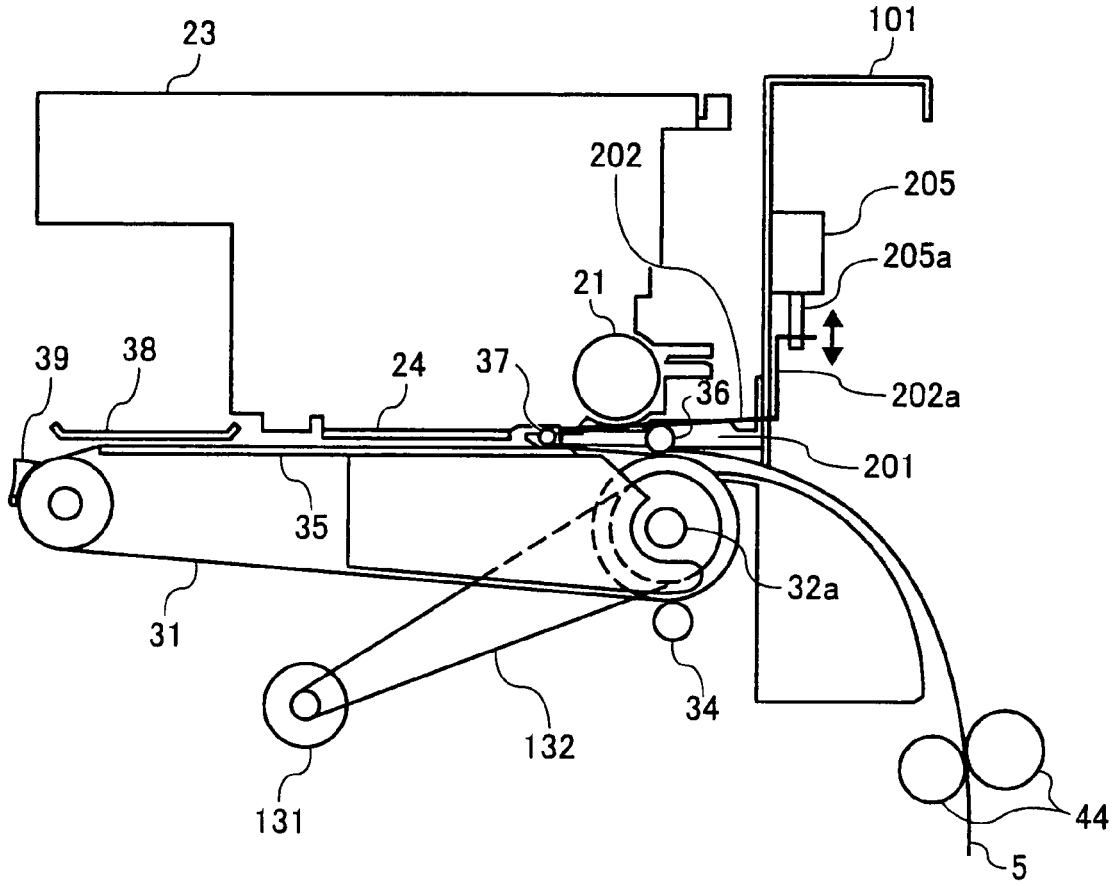
FIG. 8 is a cross-sectional diagram illustrating another example of a configuration of an engine unit in the image forming apparatus of FIG. 1.

FIG. 8 is a cross-sectional diagram illustrating another example of a configuration of an engine unit in the image forming apparatus of FIG. 1. In this example, a spring member 202 is adjustably provided to a frame 101. An attaching reference position (an end 202*a* side) of the spring member 202 is variable in up and down directions. The attaching end 202*a* of the spring member 202 is connected with a plunger 205*a* of a solenoid 205 provided on the frame 101 serving as a driving device for adjusting the pressure.

Driving the solenoid 205 causes motion of the attaching reference position of the spring member 202 in a direction shown as an arrow in FIG. 8. Therefore, the pressing force between the spring member 202 and a second pressing roller 37 varies, and the pressing force to a sheet 5 with the second pressing roller 37 also varies.

When the tip of the sheet 5 is easy to float during conveyance, the pressing force of the second pressing roller 37 is set comparatively large so that the tip of the sheet 5 may be pressed surely. On the other hand, when the float of the tip of the sheet 5 is small, the pressing force of the second pressing roller 37 is set comparatively small so as to keep conveyance of the sheet 5 in stable condition.

Although the solenoid 205 is used for adjusting the attaching reference position of the spring member 202, the attaching reference position may manually be adjusted. Further, when adjusting a gap between the sheet 5 and the recording heads 24 depending on the thickness of the sheet 5 is performed by using a relative motion of the recording heads 24 and the endless conveyance belt 31, the attaching reference position of the spring member 202 may be adjusted according to an operation of the gap adjusting.

Figure 9:
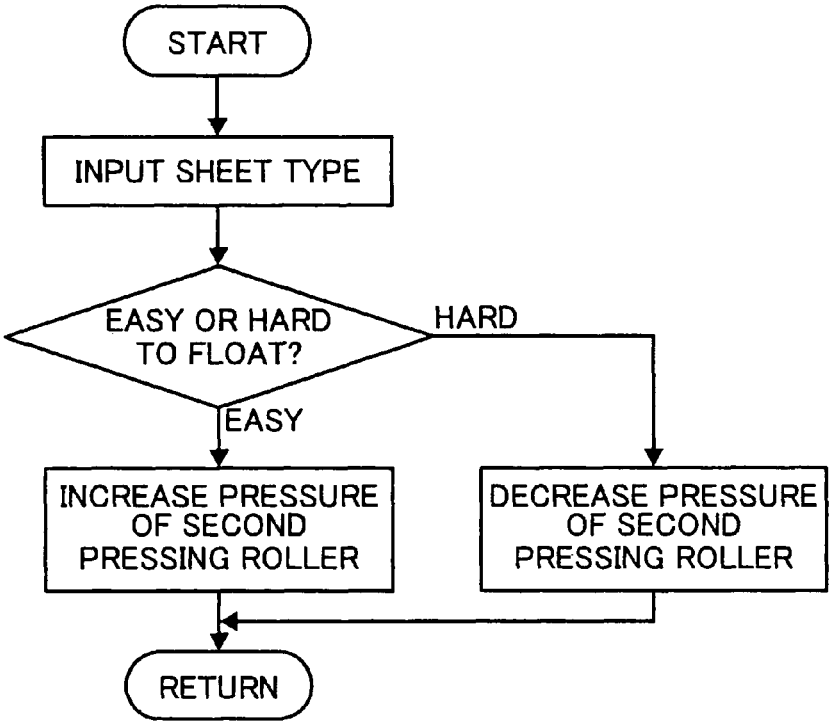
FIG. 9 is a flowchart illustrating an exemplary procedure of the present disclosure.

FIG. 9 is a flowchart illustrating an exemplary procedure of the present disclosure. Here, the main control unit 301 carries out the drive control of the solenoid 205, the attaching reference position of the spring member 202 may be changed, and the pressure by the second pressing roller 37 may be changed.

As shown in FIG. 9, after inputting information of sheet type, it is distinguished whether the tip of the sheet is easy to float or hard to float. When it is easy to float, the solenoid 205 is placed into an OFF state, the attaching reference position of the spring member 202 is placed into a low position so that the pressure by the second pressing roller 37 may be relatively high. When it is hard to float, the solenoid 205 is placed into an ON state, the attaching reference position of the spring member 202 is placed into a high position by pulling the plunger 205*a* so that the pressure by the second pressing roller 37 may be relatively low.

The information of sheet type is input through the operation panel of the main body of the image forming apparatus or input from the information processing units such as personal computers connected to this image forming apparatus. The distinguishing sheet type operation includes switching the state (ON/OFF) of the solenoid 205.

Thereby, changing the pressing force based on the information of sheet type causes a tip part of a media to be pressed down by a suitable pressure according to the kind of the media.

Figure 10:
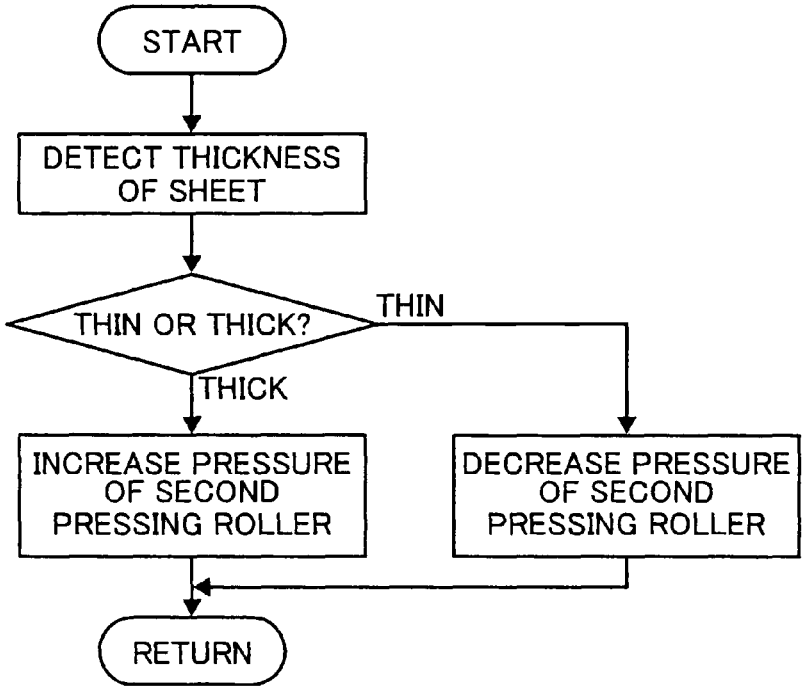
FIG. 10 is a flowchart illustrating another exemplary procedure of the present disclosure.

FIG. 10 is a flowchart illustrating another exemplary procedure of the present disclosure. As shown in FIG. 10, after inputting information of a sheet thickness detected with a thickness detector (not shown), it is distinguished whether the sheet is thin or thick. When the sheet is thick, the solenoid 205 is placed into an OFF state, the attaching reference position of the spring member 202 is placed into low position so that the pressure by the second pressing roller 37 may be relatively high. When the sheet is thin, the solenoid 205 is placed into an ON state, the attaching reference position of the spring member 202 is placed into a high position by pulling the plunger 205*a* so that the pressure by the second pressing roller 37 may be relatively low.

Thereby, changing the pressing force based on the information of the thickness of the sheet causes a tip part of a media to be pressed down by a suitable pressure according to the kind of the media.

Figure 11:
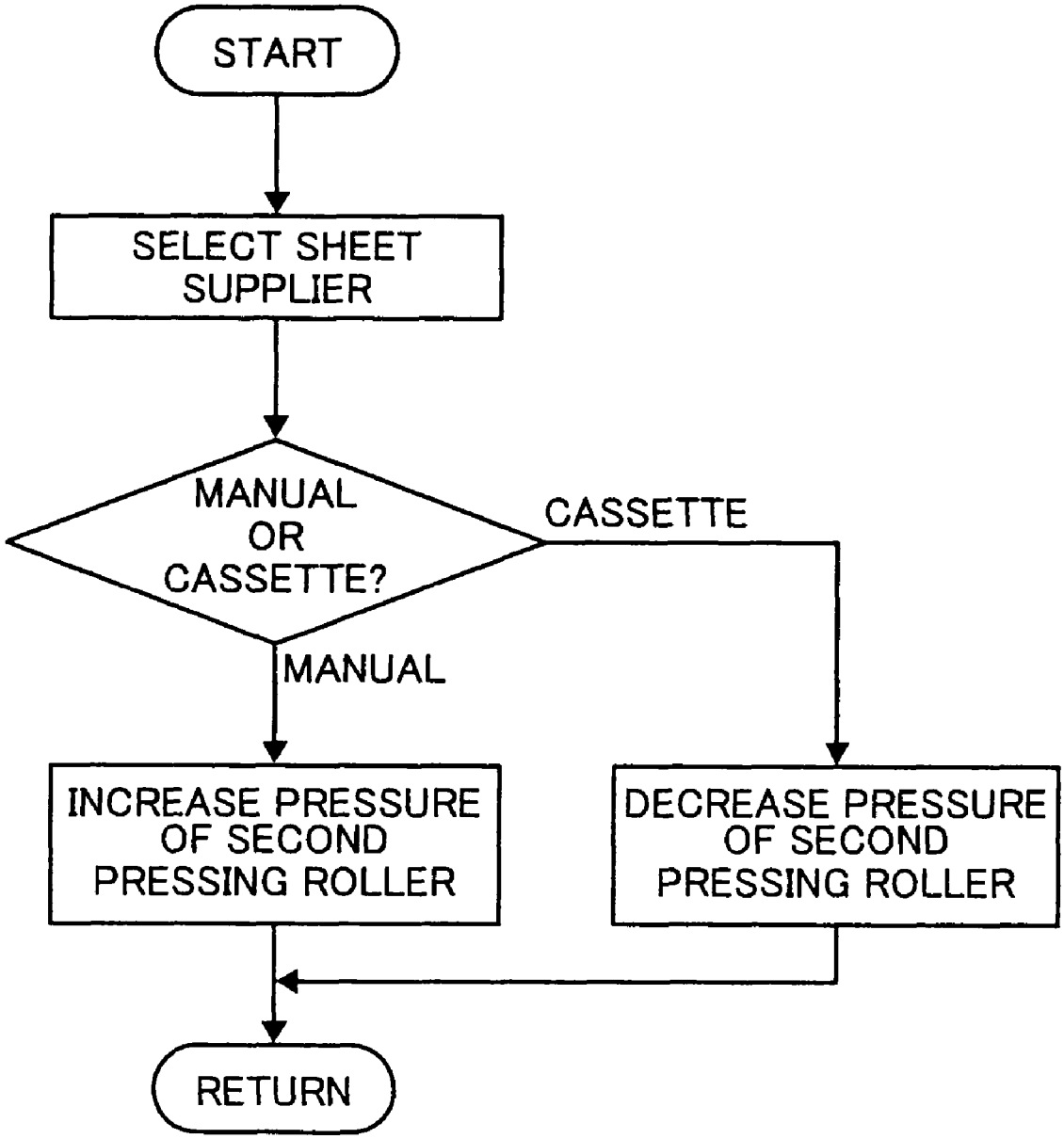
FIG. 11 is a flowchart illustrating another exemplary procedure of the present disclosure.

FIG. 11 is a flowchart illustrating another exemplary procedure of the present disclosure. As shown in FIG. 11, after inputting information of a sheet supplier, for example, selecting the manual feed tray 46 or the sheet feed cassette 41, it is distinguished whether the manual feed tray 46 or the sheet feed cassette 41 is used. When the manual feed tray 46 is used to feed the sheet, the solenoid 205 is placed into an OFF state, the attaching reference position of the spring member 202 is placed into a low position so that the pressure by the second pressing roller 37 may be relatively high. When the sheet feed cassette 41 is used to feed the sheet, the solenoid 205 is placed into an ON state, the attaching reference position of the spring member 202 is placed into high position by pulling the plunger 205*a* so that the pressure by the second pressing roller 37 may be relatively low.

The information of a sheet supplier is input through the operation panel (e.g. selecting information) of the main body of the image forming apparatus or input from the information processing units such as personal computers connected to this image forming apparatus with information as, for example, an automatic feed, a manual feed, a paper size, etc. The distinguishing sheet supplier operation includes switching the state (ON/OFF) of the solenoid 205.

When the sheet 5 is fed from the manual feed tray 46, the manual feed roller 47 presses the image forming side of the sheet 5. As a result, the tip of the sheet 5 is easy to float due to a curl caused by the manual feed roller 47. On the other hand, when the sheet 5 is fed from the sheet feed cassette 41, the sheet feed roller 42 presses the backside of the image formation of the sheet 5. As a result, the tip of the sheet 5 is hard to float due to an opposite curl caused by the sheet feed roller 42.

Therefore, changing the pressing force based on the information of the supplier of the sheet causes a tip part of a media to be pressed down by a suitable pressure according to the kind of the sheet feeding.

Furthermore, in the above-described exemplary embodiments, descriptions are provided using examples in which the subject matter of the present disclosure is applied to a multi-functional image forming apparatus. However, the subject matter of the present disclosure may be applied to other image forming apparatuses such as printers, facsimiles and so forth, and also to an image forming apparatus using a recording liquid other than ink.

Embodiments of this disclosure may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. Embodiments of the present disclosure may also be implemented by the preparation of application specific integrated circuits or by interconnecting an appropriate network of conventional component circuits, as will be readily apparent to those skilled in the art.

Any of the aforementioned methods may be embodied in the form of a system or device, including, but not limited to, any of the structure for performing the methodology illustrated in the drawings.

Further, any of the aforementioned methods may be embodied in the form of a program. The program may be stored on a computer readable media and is adapted to perform any one of the aforementioned methods, when run on a computer device (a device including a processor). Thus, the storage medium or computer readable medium, is adapted to store information and is adapted to interact with a data processing facility or computer device to perform the method of any of the above mentioned embodiments.

The storage medium may be a built-in medium installed inside a computer device main body or removable medium arranged so that it can be separated from the computer device main body. Examples of the built-in medium include, but are not limited to, rewriteable non-volatile memories, such as ROMs and flash memories, and hard disks. Examples of the removable medium include, but are not limited to, optical storage media such as CD-ROMs and DVDs; magneto-optical storage media, such as MOs; magnetism storage media, such as floppy disks (trademark), cassette tapes, and removable hard disks; media with a built-in rewriteable non-volatile memory, such as memory cards; and media with a built-in ROM, such as ROM cassettes.

Exemplary embodiments being thus described, it should be apparent after reading this patent specification that the subject matter of this disclosure may be further varied in many ways. Such variations are not to be regarded as a departure from the spirit and scope of the present disclosure, and all such modifications as would be apparent to one skilled in the art are intended to be included within the scope of the following claims.

This patent specification is based on and claims priority under 35 U.S.C. §119 of Japanese patent application No. JP2006-193465 filed on Jul. 14, 2006 in the Japanese Patent Office, the entire contents of which are incorporated herein by reference.

What is claimed:

1. An image forming apparatus to form an image on a recording medium, comprising:

a conveyance roller;

a driven roller;

a conveyance belt which is rotated by the conveyance roller while supported by the conveyance roller and the driven roller and which is configured to convey the recording medium while electrostatically attracting the recording medium;

an image forming unit configured to form an image on the recording medium;

a carriage configured to move and scan in a main scanning direction;

a carriage guide guiding the carriage;

a recording head installed in the carriage, to eject liquid droplet, disposed downstream from the carriage guide in a conveyance direction in which the recording medium is conveyed on the conveyance belt, substantially perpendicular to the main scanning direction;

a pressing member configured to press the recording medium against the conveyance belt at a position between the conveyance roller and the image forming unit, disposed upstream from the recording head in the conveyance direction and facing the conveyance roller via the conveyance belt; and a sheet tip pressing member disposed at a position that is beneath the carriage and between the recording head and the carriage guide, at a position being closer, than the pressing member, to the recording head, and configured to press the recording medium against the conveyance belt.

2. The image forming apparatus of claim 1, further comprising:

an adjuster configured to adjust a pressing force of the pressing member depending on a type of the recording medium.

3. The image forming apparatus of claim 1, further comprising:

an adjuster configured to adjust a pressing force of the pressing member depending on a thickness of the recording medium.

4. The image forming apparatus of claim 1, further comprising:

a sheet feeding device configured to feed the recording medium; and an adjuster configured to adjust a pressing force of the pressing member depending on a conveyance path of the recording medium from the sheet feeding device to the image forming unit.

5. The image forming apparatus of claim 1, further comprising:

a platen guide member configured to support the conveyance belt against a pressing force of the pressing member with the conveyance belt there between, wherein the platen guide member is disposed to counter the pressing member.

6. The image forming apparatus of claim 5, wherein an angle formed by a tangent line, which is formed between the edge of the platen guide member and the conveyance roller, and a surface of the platen guide member facing the recording head of the image forming unit is greater than 0° and not greater than 1.30°.

7. The image forming apparatus of claim 1, wherein the pressing member includes a pressing roller configured to press the recording medium against the conveyance belt, and a pressing device configured to press the pressing roller with a pressing force such that the pressing roller presses the recording medium against the conveyance belt.

8. The image forming apparatus of claim 7, wherein the pressing device can adjust the pressing force.

9. The image forming apparatus of claim 7, wherein the pressing device is a blade spring, and wherein an installment position of the blade spring is adjustable to adjust the pressing force.

10. The image forming apparatus of claim 9, further comprising:

an adjuster configured to adjust the installment position of the blade spring.

11. The image forming apparatus of claim 1, wherein the sheet tip pressing member presses a front tip of the recording medium against the conveyance belt when said front tip of the recording medium is beneath the carriage and between the recording head and the carriage guide.

12. An image forming apparatus to form an image on a recording medium, the image forming apparatus having a front end and a rear end and comprising:

a conveyance roller;

a driven roller;

a conveyance belt which is rotated by the conveyance roller while supported by the conveyance roller and the driven roller and which is configured to convey the recording medium while electrostatically attracting the recording medium;

an image forming unit configured to form an image on the recording medium;

a carriage configured to move and scan in a main scanning direction;

a carriage guide guiding the carriage;

a recording head installed in the carriage, to eject liquid droplet, disposed downstream from the carriage guide in a conveyance direction in which the recording medium is conveyed on the conveyance belt, substantially perpendicular to the main scanning direction;

a pressing member configured to press the recording medium against the conveyance belt at a position between the conveyance roller and the image forming unit, disposed upstream from the recording head in the conveyance direction and facing the conveyance roller via the conveyance belt; and a sheet tip pressing member disposed at a position that is beneath the carriage and between the recording head and the carriage guide, at a position being closer, than the pressing member, to the recording head, and configured to press the recording medium against the conveyance belt; and a platen guide member configured to support the conveyance belt against a pressing force of the pressing member with the conveyance belt there between, wherein the platen guide member is disposed to counter the pressing member, wherein an angle formed by a tangent line, which is formed between the edge of the platen guide member and the conveyance roller and a surface of the platen guide member facing the recording head of the image forming unit is greater than 0° and is not greater than 1.30°.

* * * * *